US006968759B2

(12) United States Patent
Becker et al.

(10) Patent No.: US 6,968,759 B2
(45) Date of Patent: Nov. 29, 2005

(54) ELECTRONIC TORQUE WRENCH

(75) Inventors: Thomas P. Becker, Kenosha, WI (US); David F. Brekke, Franksville, WI (US); David Duvan, Chino, CA (US); Rolf Segger, Duesseldorf (DE)

(73) Assignee: Snap-on Incorporated, Pleasant Prairie, WI (US)

( * ) Notice: Subject to any disclaimer, the term of this patent is extended or adjusted under 35 U.S.C. 154(b) by 0 days.

(21) Appl. No.: 10/293,006

(22) Filed: Nov. 13, 2002

(65) Prior Publication Data

US 2003/0094081 A1 May 22, 2003

Related U.S. Application Data

(60) Provisional application No. 60/333,033, filed on Nov. 14, 2001.

(51) Int. Cl.[7] ..... B24B 23/144
(52) U.S. Cl. ..... 81/479; 81/478; 73/862.23
(58) Field of Search ..... 81/479, 478, 469, 81/467; 73/862.21–862.26

(56) References Cited

U.S. PATENT DOCUMENTS

| | | | | |
|---|---|---|---|---|
| 2,289,238 A | | 7/1942 | Brunelle | |
| 4,125,016 A | * | 11/1978 | Lehoczky et al. | 73/862.23 |
| 4,397,196 A | | 8/1983 | Lemelson | |
| 4,426,887 A | | 1/1984 | Reinholm et al. | |
| 4,558,601 A | * | 12/1985 | Stasiek et al. | 73/862.23 |
| 4,562,746 A | * | 1/1986 | Petit | 73/862.23 |
| 4,669,319 A | * | 6/1987 | Heyraud | 73/862.23 |
| 4,958,541 A | | 9/1990 | Annis et al. | |
| 5,563,482 A | * | 10/1996 | Shaw et al. | 73/862.23 |
| 6,070,506 A | | 6/2000 | Becker | |
| 6,167,788 B1 | * | 1/2001 | Schonberger et al. | 81/467 |
| 6,234,051 B1 | * | 5/2001 | Bareggi | 81/479 |
| 6,526,853 B2 | * | 3/2003 | Jenkins | 81/479 |
| 6,698,298 B2 | * | 3/2004 | Tsuji et al. | 73/862.21 |
| 2002/0152820 A1 | * | 10/2002 | Tsuji et al. | 73/862.21 |

FOREIGN PATENT DOCUMENTS

| | | |
|---|---|---|
| DE | 698 160 | 11/1940 |
| DE | B 25 23/144 | 8/1996 |
| DE | 296 15 123 | 2/1998 |
| DE | 200 15 485 | 12/2000 |
| DE | B 25 B 23/142 | 1/2001 |
| DE | 201 00 472 | 4/2001 |
| EP | 0 282 304 | 10/1988 |
| EP | 0 372 247 | 9/1989 |
| EP | 0 362 696 | 4/1990 |
| EP | 0 502 451 | 2/1992 |
| EP | 1 022 097 | 1/2000 |
| EP | 1 038 638 | 3/2000 |
| WO | WO 98/38013 | 3/1998 |
| WO | WO 00/64640 | 2/2000 |

* cited by examiner

*Primary Examiner*—Hadi Shakeri
(74) *Attorney, Agent, or Firm*—Seyfarth Shaw LLP

(57) ABSTRACT

An electronic torque wrench has inner and outer telescoping housing portions and a battery tray assembly telescopically receivable in the inner housing portion and a bezel assembly receivable in an aperture in the outer housing portion and interconnected with the housing portions and the battery support assembly by a single fastener. The bezel assembly carries torque measuring circuitry including a microcontroller, and a four-key pad including arrow keys for incrementing and decrementing a preset torque level at any time, an on/zero key and a units key for toggling among plural different units of torque measurement. The preset torque level is displayed until torque is applied or a key is pressed and can be changed and displayed at anytime.

17 Claims, 10 Drawing Sheets

ELECTRONIC TORQUE WRENCH

RELATED APPLICATION

This application claims the benefit of the filing date of copending U.S. Provisional Application No. 60/333,033, filed Nov. 14, 2001.

BACKGROUND

This application relates to wrenching tools, and, in particular, to torque-measuring and recording wrenches.

Various types of torque wrenches are known. One common type of mechanical torque wrench is what is known as a "click"-type wrench which generates an audible sound, such as a "click," when a predetermined value of applied torque is reached. Such wrenches are disclosed, for example, in U.S. Pat. No. 4,485,703. In this type of wrench, when a predetermined set force is transmitted by the wrench to a workpiece, certain parts within the wrench move rapidly from a normal position to an actuated position in a manner such as to generate an audible click-like sound and tactile sensation to signal the operator that a predetermined set torque has been reached. The predetermined torque is set by the operator by rotating coaxial, telescoping tubular parts, so that as one part is rotated relative to the other it advances axially relative to the other along scale indicia, in the nature of a micrometer. Such wrenches have the advantage that their manner of use is simple and highly intuitive, so that the wrenches can easily be used with little or no training. Additionally, with this type of wrench, the operator can always see where the scale is set so that he can always ascertain the predetermined set torque value while the wrench is in use.

Other types of mechanical torque wrenches have gauges with one or more pivoting dials. One such wrench has two dials, one of which tracks the applied torque both up and down, and the other of which tracks the applied torque only up, so that it registers the peak torque applied.

Various types of electronic torque wrenches are also known which utilize electronic circuitry for measuring and/or indicating torque values. Such electronic devices may have the advantage of being more precise or accurate in setting predetermined torque values and in measuring applied torque. However, such electronic torque wrenches are typically much less intuitive to use than the mechanical torque wrenches described above. Such wrenches typically have a keypad with multiple keys which are capable of a number of specialized functions, many of which may rarely, if ever, be used by a particular operator. Considerable training is required to master the operation of such wrenches and the basic operational functions may be very non-intuitive. Also, in order to simultaneously display both a pre-set torque value and an applied torque value, such electronic wrenches must have relatively complex and expensive displays. While wrenches with more simplified and inexpensive displays are known, they typically register a display of the preset torque while it is being set, but then, after the setting function is accomplished, the display returns to zero in preparation for recording the applied torque during use of the wrench. If the operator puts the wrench down after setting the predetermined torque and returns to it later for use, he will have to typically perform some keypad function in order to view the preset torque. Also, such electronic wrenches lack the familiar audible/tactile indication when the predetermined set torque value is reached, and may provide some other type of visible and/or audible indication, or even require that the user watch a display.

SUMMARY

There is described in this application an improved electronic torque wrench which is more intuitive to use than the previous electronic wrenches, simulating basic features of mechanical torque wrenches while maintaining advantages of prior electronic torque wrenches.

An embodiment of an electronic torque wrench includes a workpiece-engaging head carried by a housing which also carries torque measuring apparatus including a processor operating under stored program control. A user interface is coupled to the torque measuring apparatus and includes a data input device and annunciator apparatus. The processor program responds to the input device for selectively setting or changing a preset torque level at any time, and compares torque values measured by the torque measuring apparatus with the preset torque level for causing the annunciator apparatus to produce an indication when the measured torque value coincides with the preset torque level.

An embodiment also includes an electronic torque wrench, wherein the user interface includes a keypad having an on/zero key for powering up the wrench and setting a zero level, a units key for toggling among plural different units of torque measurement, an increment key for incrementing a preset torque level and a decrement key for decrementing a preset torque level.

A torque wrench embodiment also includes a housing assembly including telescoping tubular inner and outer housing portions with registered apertures therein and a bezel assembly disposable in the outer housing portion aperture and carrying torque measuring apparatus, the housing portions and the bezel assembly all being interconnected by a single fastener.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
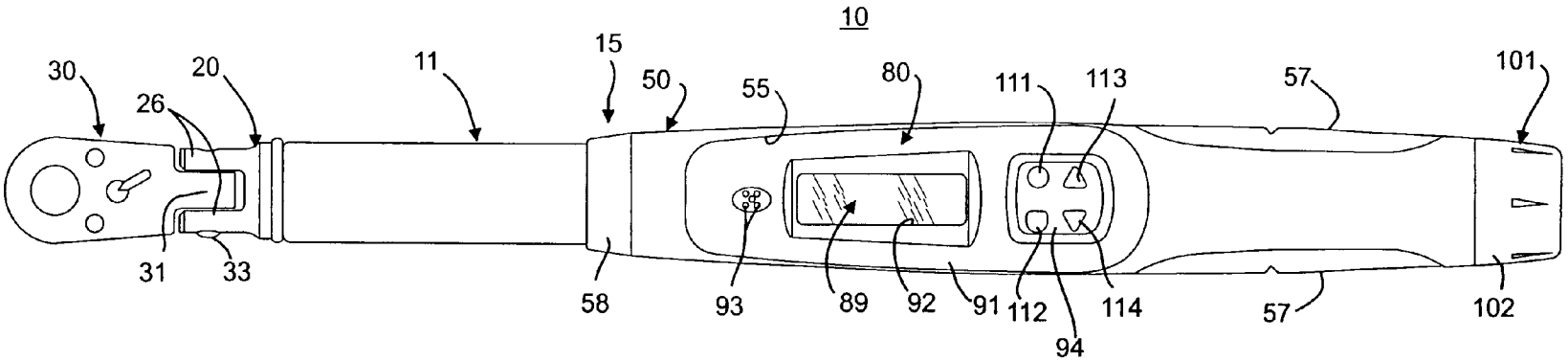
FIG. 1 is a top plan view of an embodiment of an electronic torque wrench having a four-key keypad.
Figure 2:
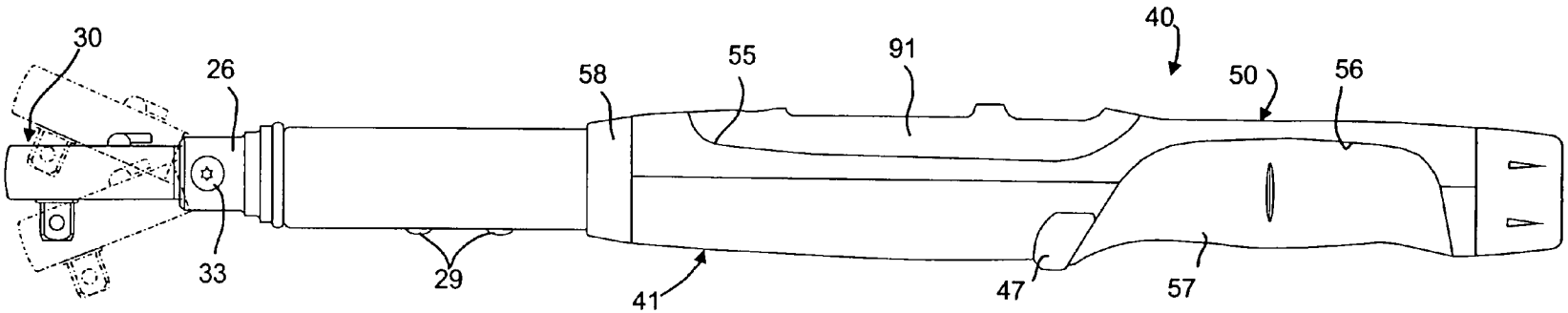
FIG. 2 is a front elevational view of the torque wrench of FIG. 1.
Figure 3:
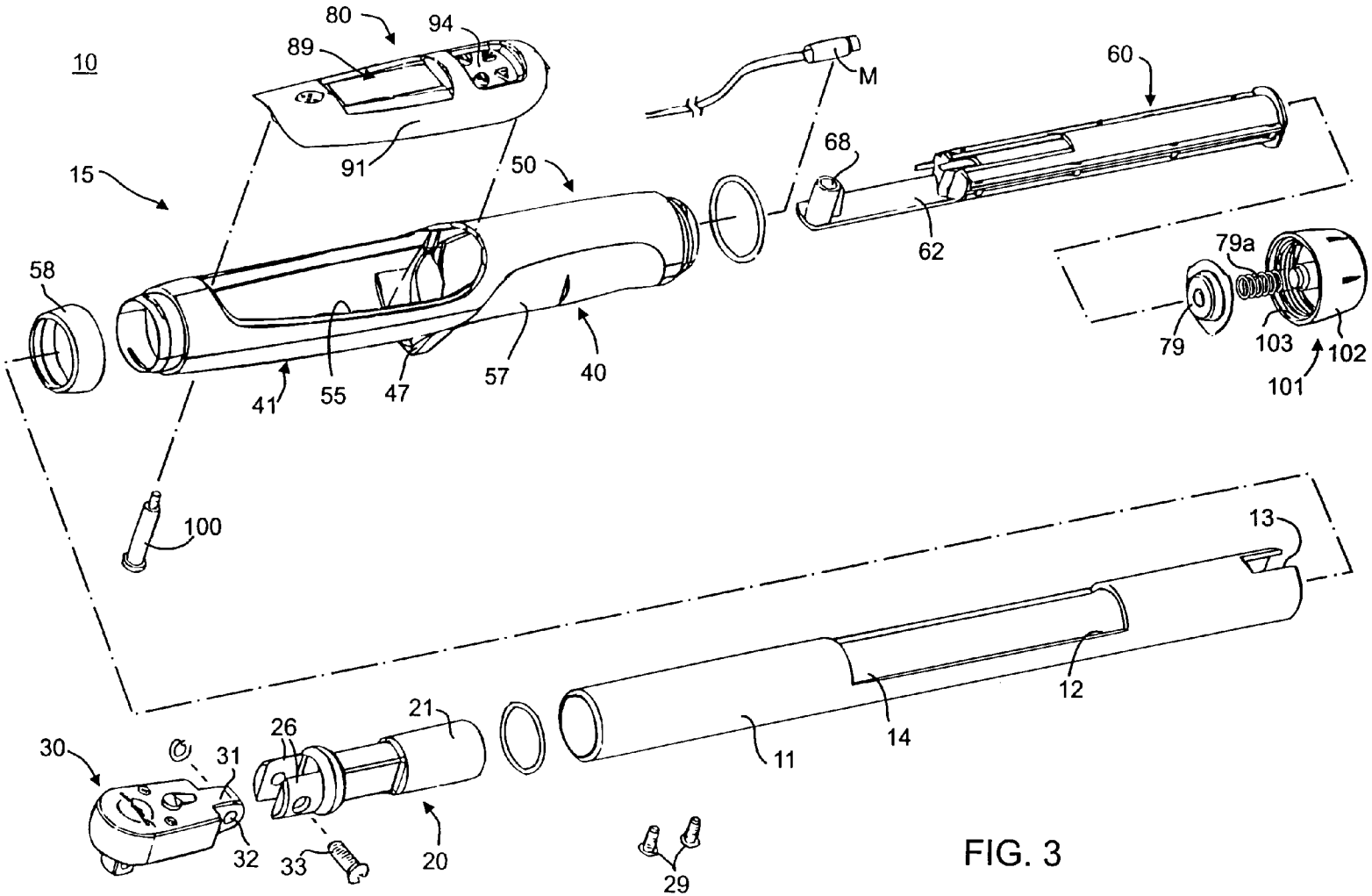
FIG. 3 is a slightly reduced, exploded, perspective view of the torque wrench of FIG. 1.
Figure 7:
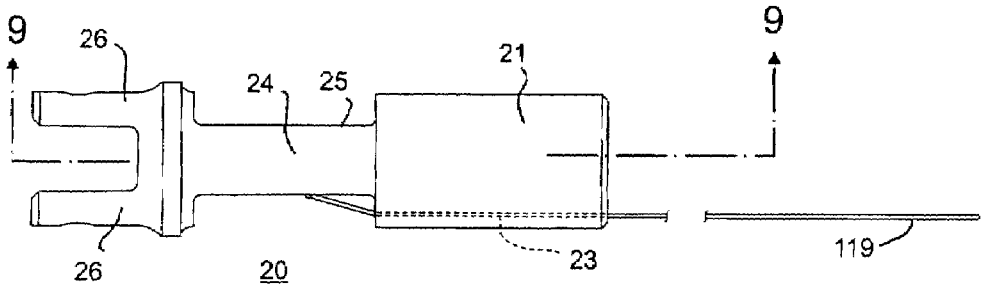
FIG. 7 is an enlarged, top-plan view of the sensory yoke and strain gauge of the torque wrench of FIG. 3.
Figure 8:
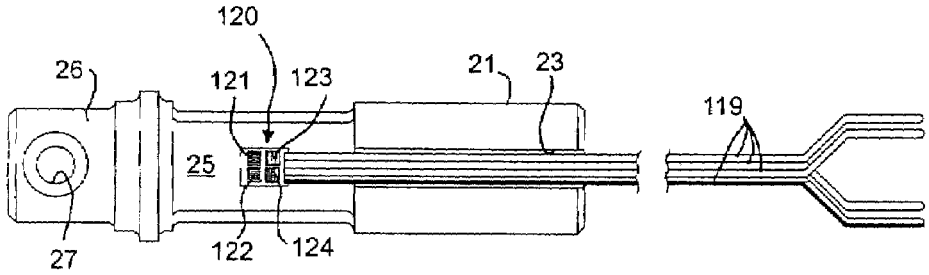
FIG. 8 is a front elevational view of the sensory yoke and strain gauge of FIG. 7.
Figure 9:
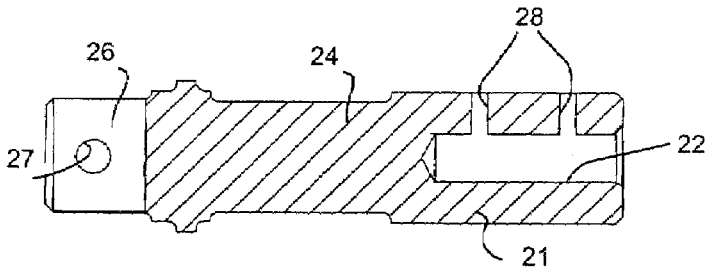
FIG. 9 is sectional view taken generally along the line 9—9 in FIG. 7.

Referring to FIGS. 1–3, there is illustrated an electronic torque wrench, generally designated by the numeral 10, having a housing 15 including an inner housing portion in the form of an elongated cylindrical body tube 11 with a large, elongated, rectangular aperture 12 in the upper portion thereof intermediate its ends and a rectangular notch 13 formed in the upper rear edge thereof. A circular hole 14 is formed in the bottom portion adjacent to the forward end of the notch 12. Referring also to FIGS. 7–9, a sensor yoke 20 has a cylindrical base 21 which is fitted in the forward end of the body tube 11, the base 21 having an axial bore 22 formed in the rear end thereof and a rectangular groove or channel 23 formed in the outer surface thereof and extending longitudinally from the rear end of the base 21 to about midway along its length. The forward half of the base 21 defines a reduced-diameter neck portion 24 having parallel flats 25 formed on opposite sides thereof, one of which defines a recess communicating with the channel 23. Projecting forwardly from the front end of the base 21 are a pair of spaced clevis legs 26, respectively having aligned pivot holes 27 therethrough. The base 21 has two internally threaded bores 28 formed radially therein for respectively receiving fasteners 29 (see FIG. 3) to secure the yoke 20 in place in the body tube 11.

A ratchet head 30 is coupled to the sensor yoke 20. The ratchet mechanism of the head 30 may be of the type disclosed in U.S. Pat. No. 6,125,722. The head 30 has a neck 31 projecting rearwardly therefrom which is received between the clevis legs 26 of the yoke 20, the neck 31 having a bore 32 therethrough which aligns with the pivot holes 27 for receiving a pivot screw 33 to allow pivotal movement of the head 30 relative to the yoke 20, as indicated in phantom in FIG. 2. While a pivoting or indexible head 30 is illustrated, it will be appreciated that other types of ratcheting or non-ratcheting, pivoting or non-pivoting, fixed or removable heads could be mounted on the forward end of the body tube 1, with suitable modifications to the sensor yoke 20.

Figure 4:
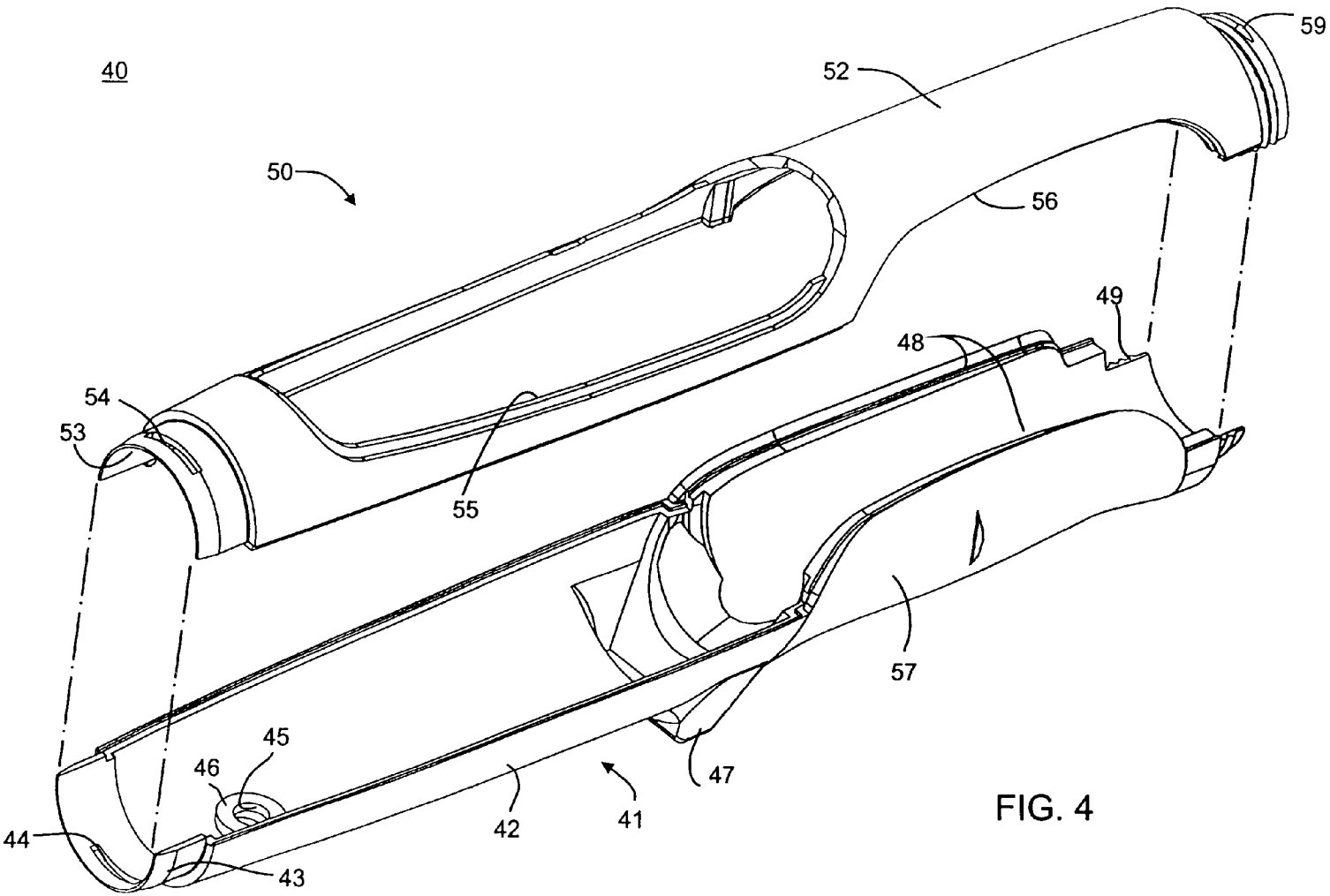
FIG. 4 is an exploded view of the handle assembly of the wrench of FIG. 1.

Referring also to FIG. 4, the housing 15 includes an outer housing portion in the form of a generally tubular handle assembly 40, which is of fundamentally two-part construction, including a lower housing assembly 41 and an upper housing 50, which are mateably joined and secured together, as by ultrasonic welding. The lower housing assembly 41 has a generally part-cylindrical body 42 with a reduced-diameter neck portion 43 at the forward end thereof provided with a circumferentially extending rectangular slot 44. A circular hole 45 is formed through the body 42 adjacent to the neck portion 43 and is surrounded at the inner surface of the body 42 by a bushing 46. A foot 47 projects downwardly from the body 42 intermediate its ends. The rear half of the body 42 is provided with upstanding, arcuate grip flanges 48. Projecting rearwardly from the body 42 is a reduced-diameter, externally threaded part-cylindrical neck portion 49.

The upper housing 50 has a generally part-cylindrical body 52 having a reduced-diameter neck portion 53 projecting from its forward end with a rectangular, circumferentially extending slot 54 therein. A large, elongated, generally rectangular aperture 55 is formed in the forward half of the body 52. The lower edges of the body 52 are provided with large cutouts 56 in the rear half thereof for respectively accommodating the grip flanges 48. An externally threaded, reduced-diameter part-cylindrical neck portion 59 projects rearwardly from the body 52.

In assembly, the lower housing assembly 41 and the upper housing 50 are joined along their longitudinal edges, such as by ultrasonic welding, with the grip flanges 48 respectively received in the cutouts 56, the neck portions 43 and 53 cooperating to form a forward neck and the neck portions 49 and 59 cooperating to form a rearward neck. A trim ring 58 (FIG. 3) is fitted over the forward neck and has tabs (not shown) which respectively snap fit into the slots 44 and 54 to retain the trim ring 58 in place. The rear portion of the body 42, including the grip flanges 48, may be over molded with a grip 57 (FIGS. 3 and 4) formed of a suitable elastomeric material, such as that sold under the trade name SANTOPRENE.

Figures 5, 14:
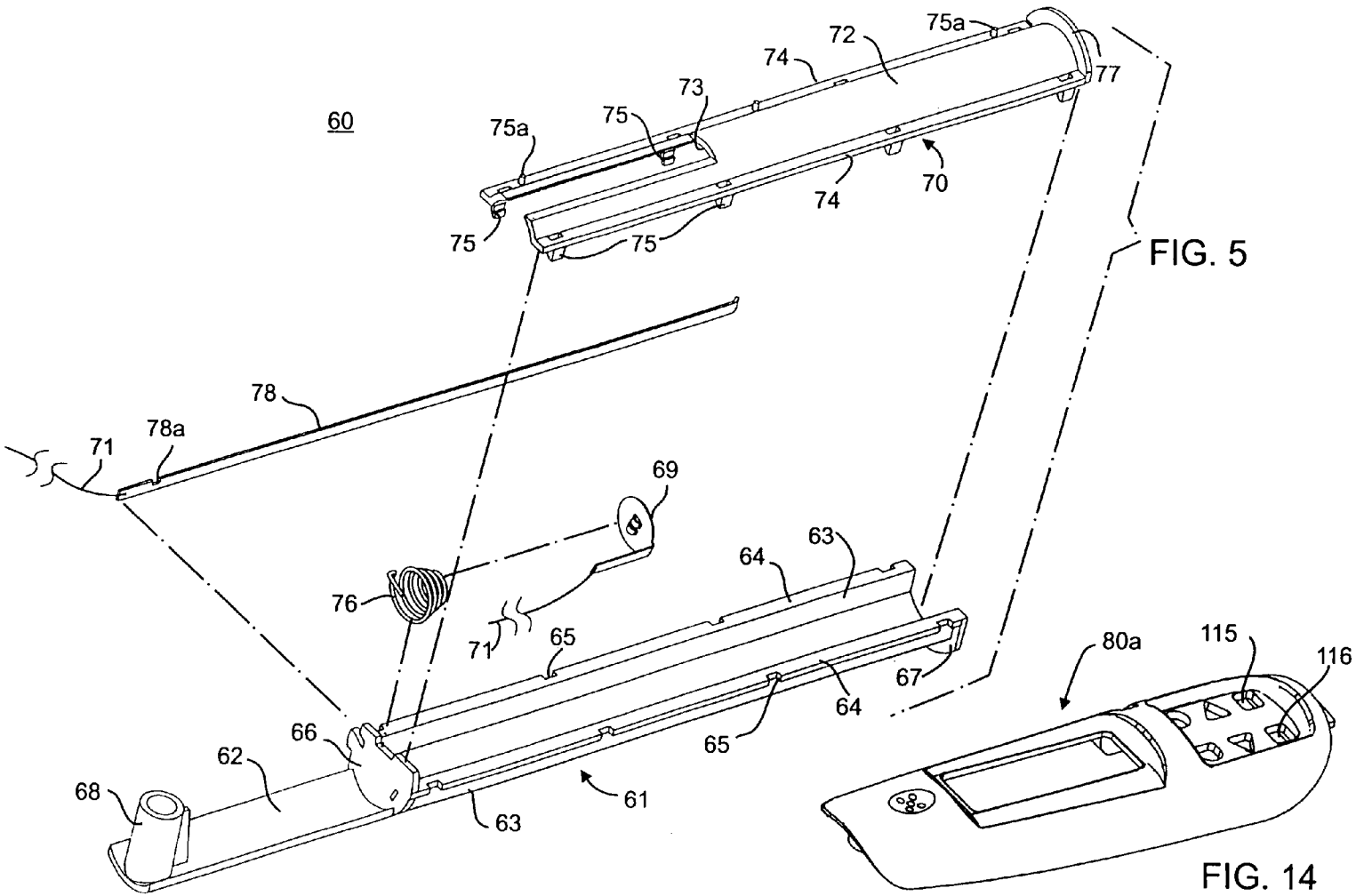
FIG. 5 is an enlarged, exploded, perspective view of the battery tray of the torque wrench of FIG. 3.
FIG. 14 is a view similar to FIG. 11 of a modified bezel.

Referring also to FIG. 5, the torque wrench 10 is provided with a battery support or tray assembly 60, which is of fundamentally two-part construction, including a lower tray 61 and an upper tray 70. The lower tray 61 has an elongated, part-cylindrical base 62, provided along approximately the rearward two-thirds thereof with upstanding sides 63, respectively provided at their upper edges with laterally outwardly extending flanges 64, each having a plurality of longitudinally spaced rectangular notches 65 in the outer edge thereof. The sides 63 are joined at their forward ends by an upstanding partition 66, integral with the base 62. An arcuate, radially extending end flange 67 projects from the base 62 and sides 63 at their rearward ends. Projecting upwardly from the base 62 at its forward end is a cylindrical bushing 68.

The upper tray 70 has a part-cylindrical base 72 with a length substantially equal to the distance between the partition 66 and the end flange 67 of the lower tray 61. Formed in the forward end of the base 72 is an elongated rectangular notch 73. Integral with the base 72 along its opposite side edges are laterally outwardly extending flanges 74, respectively provided with depending, longitudinally spaced-apart posts or stakes 75. Projecting upwardly from one of the flanges 74 are a plurality of longitudinally-spaced, short lugs 75*a*. In assembly, the upper tray 70 is fitted over the lower tray 61, with the flanges 74 respectively abutting the flanges 64 and the posts 75 respectively snap-fitted into the notches 65 (see FIG. 3) to form a generally cylindrical compartment closed at the forward end by the partition 66 and open at the rearward end. A helical compression spring 76 is seated at the forward end of the compartment against the partition 66 and may rearwardly urge a suitable contact plate 69. An elongated contact strip 78 lies along the outer surface of the one flange 75 and has a notch 78*a* for receiving a lug 75*a* to position the strip. The rear end of the contact strip 78 is bent to make contact with a rear contact plate 79, which is biased forwardly by a helical compression spring 79*a* (see FIG. 3). The battery tray assembly 60 is dimensioned to receive three series-stacked, standard "AA" alkaline cells, with a positive terminal contacting the contact plate 69 and a negative terminal contacting the contact plate 79. A tab on the contact plate 69 and the forward end of the contact strip 78 will, respectively, be connected by suitable soldered ribbon wires 71 to the remainder of the circuitry, to be described more fully below.

Referring to FIG. 3, in assembly of the housing 15, the rear end of the body tube 11 is telescopically received in the forward end of the handle assembly 40 until the aperture 12 lies immediately beneath the aperture 55, substantially in registry therewith. The forward end of the battery tray assembly 60 is then telescopically received in the rear end of the handle assembly 40 and into the rear end of the body tube 11 until the bushing 68 is in registry with the hole 14 in the body tube 11. The notch 13 in the body tube 11 will then be in registry with a motor holder receptacle (not shown) formed at the rear end inside the upper housing 50.

Figure 10:
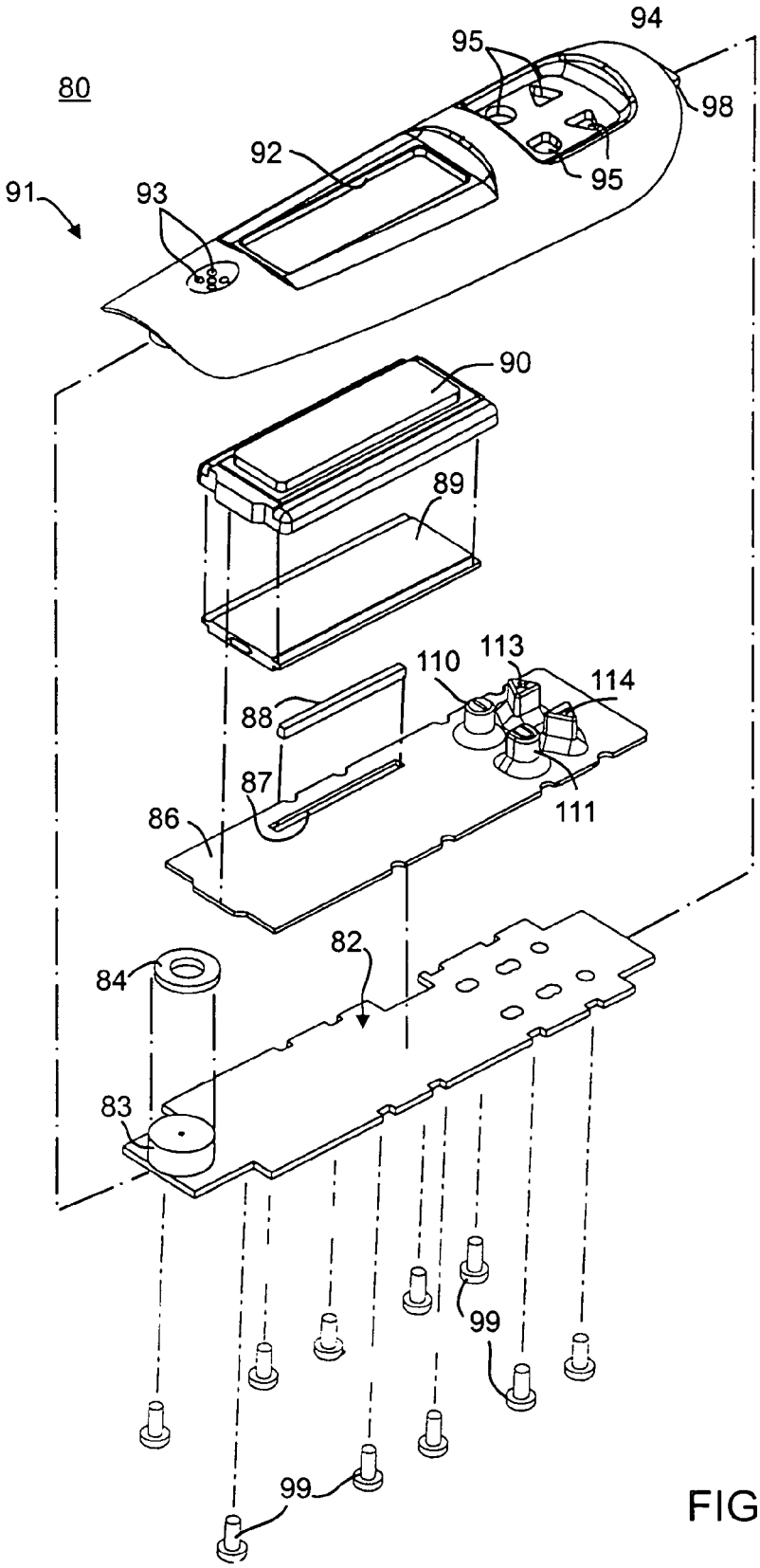
FIG. 10 is an enlarged, exploded, perspective view of the bezel assembly of the torque wrench of FIGS. 2 and 3.
Figure 11:
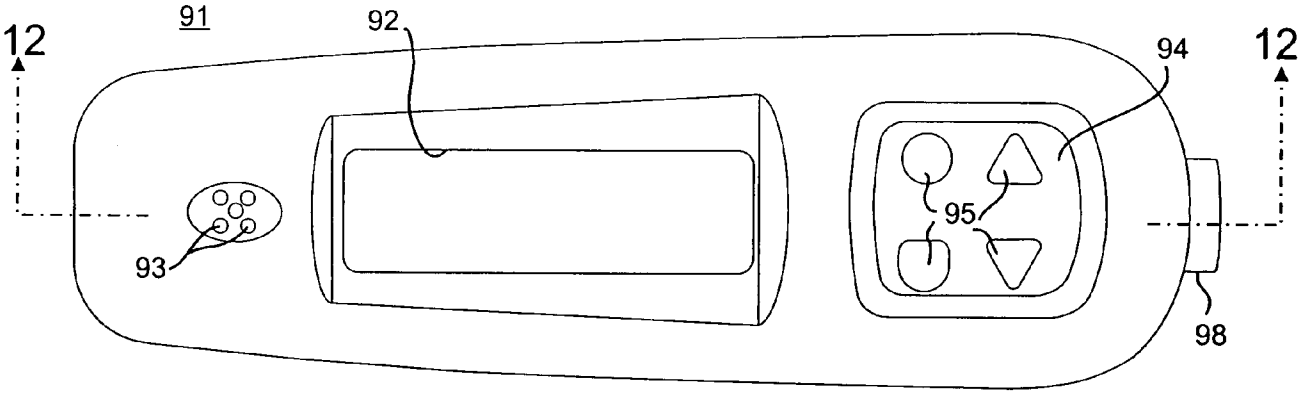
FIG. 11 is a top plan view of the bezel of FIG. 10.
Figure 12:
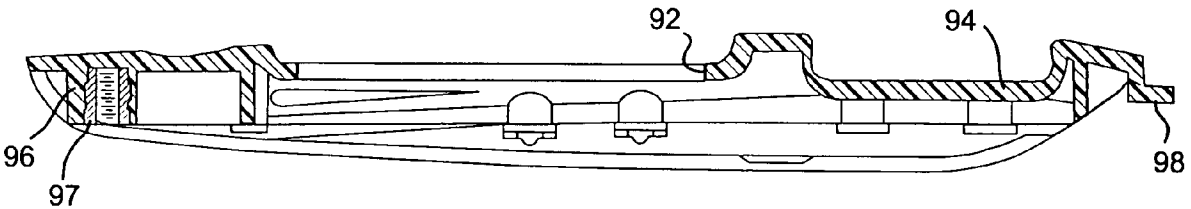
FIG. 12 is a sectional view taken generally along the line 12—12 in FIG. 11.
Figure 13:
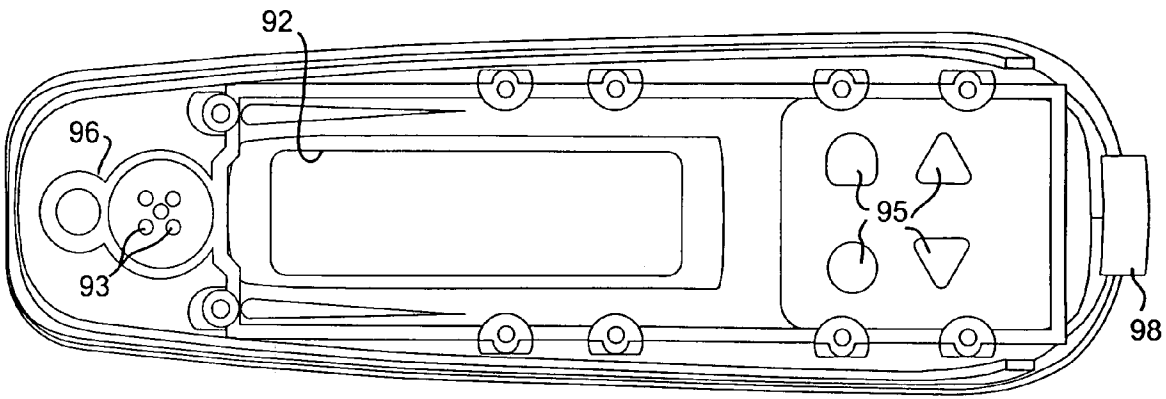
FIG. 13 is a bottom plan view of the bezel of FIG. 11.

Referring now also to FIGS. 10–13, the housing 15 includes a bezel assembly 80, the parts of which are illustrated in FIG. 10. The bezel assembly 80 includes a generally rectangular printed circuit board ("PCB") assembly 82. Mounted on the PCB assembly 82 is a buzzer 83, provided with a seal 84. A keypad plate 86 overlies the PCB assembly 82 and includes four keys. Formed in the keypad plate 86 is a longitudinally extending, narrow rectangular notch 87. An elongated, thin, elastomeric connector 88 is received in the notch 87 and provides connection between terminals on the PCB assembly 82 and terminals on an LCD display 89, which is provided with a lens 90.

The bezel assembly 80 also includes a generally part-cylindrical bezel 91, which is dimensioned to mateably fit in and close the aperture 55 in the handle assembly 40 (see FIG. 3). The bezel 91 has a generally rectangular aperture 92 therein dimensioned to receive the upper portion of the lens 90. Formed through the bezel 91 adjacent to the forward end thereof are a plurality of small apertures 93 for the buzzer 83. Formed in the upper surface of the bezel 91 at the rear end thereof is a generally rectangular recess 94, in the bottom wall of which are formed four keyholes 95, respectively positioned and shaped to receive the keys of the keypad plate 86. Depending from the front end of the bezel 91 is a cylindrical bushing 96, which receives an internally threaded insert 97. A generally rectangular tab 98 depends from and projects rearwardly from the rear end of the bezel 91.

In assembly, the PCB assembly 82 is fixedly secured to the bezel 91 by suitable means, such as screws 99, with the remaining parts of the bezel assembly 80 illustrated in FIG. 10 sandwiched therebetween. The elastomeric connector 88, which is a type of connector normally used to accommodate considerable flexing between connected parts is, in this case, very thin so as to provide a low-profile and rigidly-assembled bezel assembly 80 with minimal relative movement of internal parts.

The keypad plate 86 illustrated in FIG. 10 is provided with four keys, the functions of which will be described below. In a modified for of the torque wrench 10, additional keys may be provided, in which case a modified keypad plate would be used and the bezel 91 would be modified to provide an appropriate number of (e.g., six) keyholes. Such a modified bezel assembly is illustrated in FIG. 14 and is designated 80A and is substantially identical to the bezel assembly 80, except for the number of keys and the fact that an output jack and output jack cover and associated port (not shown) may be provided.

The assembled bezel assembly 80 or 80A is fitted into the aperture 55 in the handle assembly 40, with the tab 98 slipped beneath the wall of the upper housing 50 at the rear end of the aperture 55. When thus installed, the bushing 96 and threaded insert 97 will register with the bushing 68 of the battery tray assembly 60 and the hole 14 in the body tube 11 (see FIG. 3), so that a single screw 100 may be received through the hole 14 and the bushing 68 and threaded into the insert 97 to hold the entire assembly together.

Figure 6:
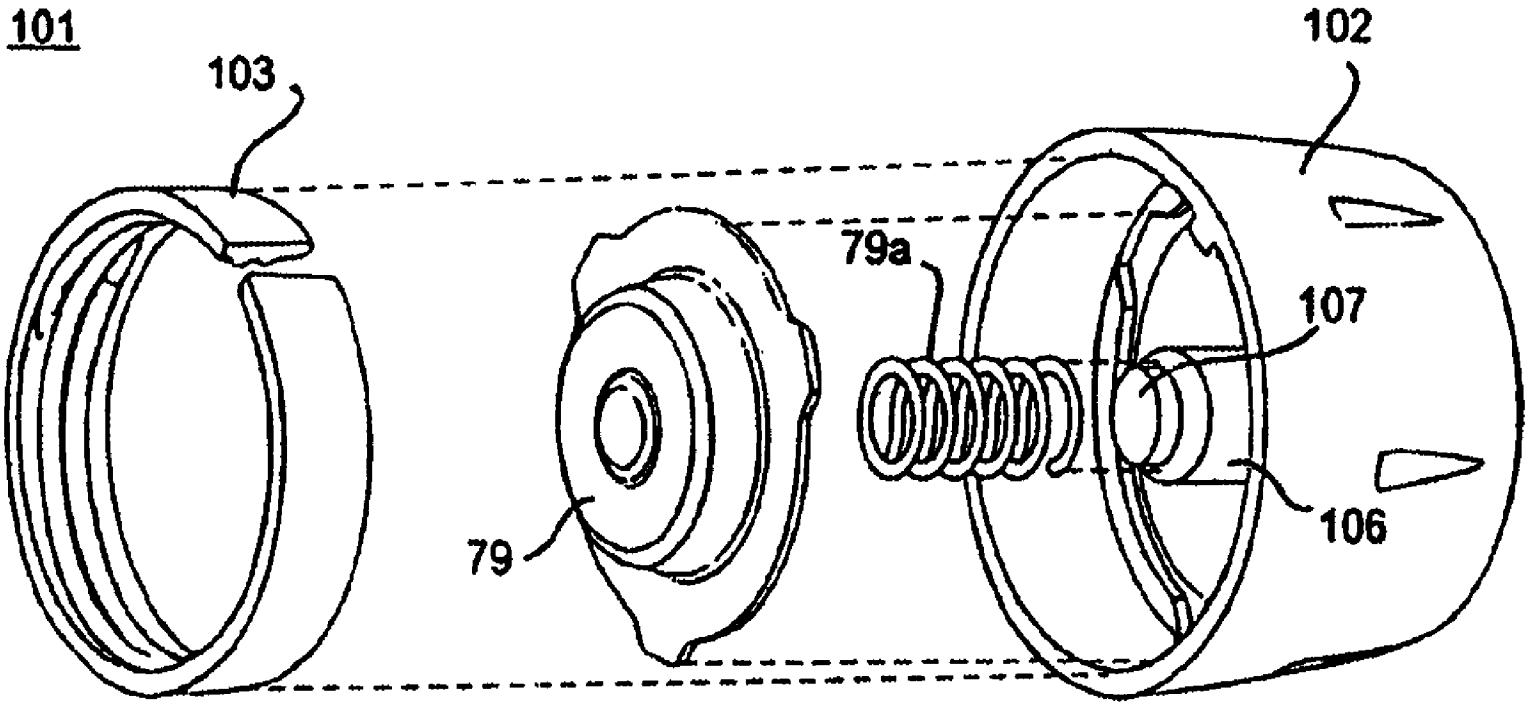
FIG. 6 is an enlarged, exploded, perspective view of the end cap assembly of the torque wrench of FIG. 3.

Referring to FIGS. 3 and 6, the rear end of the housing 15 is closed by an end cap assembly 101, which includes a generally cup-shaped end cap 102 and a threaded insert 103 adapted for threaded engagement with the threaded neck portions 49, 59 of the handle assembly 40. The contact plate 79 and spring 79*a* may be seated in the end cap 102 against an end surface of a post 106, the spring receiving a centering lug 107 projecting from the end of the post 106. Thus, when the end cap assembly 101 is mounted in place, the spring 79*a* resiliently urging the contact plate 79 against the rear end of the strip 78. If desired, an alternative form of end cap assembly (not shown) could be provided with a transverse hanging hole formed therethrough.

Referring to FIG. 10, the four keys of the keypad plate 86 include an "on/zero" key 111, a "units" key 112 for toggling among different torque-measurement units, an "increment" key 113 and a "decrement" key 114. A storage key 115 and a download key 116 could also be provided in a six-key bezel assembly 80A (see FIG. 14). To further distinguish the keys, the key 111 is circular in shape, the key 112 is "U"-shaped, and the keys 113 and 114 are triangular to simulate arrows. The storage and download keys 115, 116 if provided, may be square.

The wrench 10 includes a strain gauge assembly 120. Referring to FIGS. 7 and 8, the strain gauge assembly 120 includes 4 gauges arranged in a bridge network, including two deflection sensing gauges 121 and 122 and Poisson correction and temperature compensation gauges 123 and 124. The strain gauge assembly 120 is physically mounted on one of the flats 25 of the sensor yoke 20, the terminal strips thereof being connected to the PCB assembly 82 by ribbon wires 119 which extend through the channel 23 in the sensor yoke 20.

The wrench 10 also includes a vibratory motor M, which is physically accommodated in a receptacle formed at the rear end inside the upper housing 50 (not shown) and in the notch 13 of the body tube 11, and is connected by wires to the PCB assembly 82.

Figure 15:
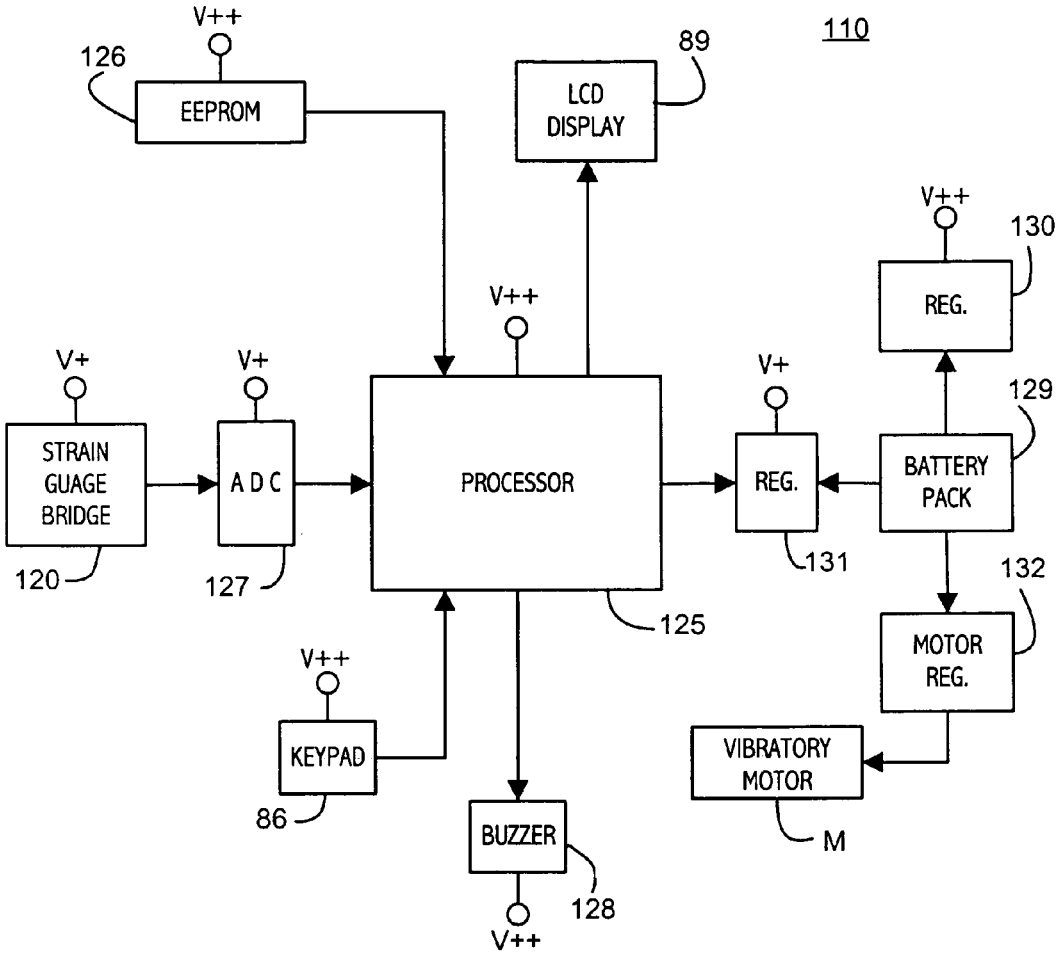
FIG. 15 is a functional block diagram of the electronic circuitry of the torque wrench of FIGS. 1 and 2.

Referring to FIG. 15, there is illustrated a functional block diagram of an electronic circuit 110 for controlling the operation of the torque wrench 10. The circuit 110 includes a processor 125, which may be in the nature of a suitable microcontroller, such as an NEC model 789456, which may have a crystal-controlled clock speed of 4.915 MHz. The processor 125 operates under control of a program, which may be stored within the processor. An EEPROM 126 may be provided to store setup, preset and calibration parameters. The output of the strain gauge bridge 120 is applied to the processor 125 through an analog-to-digital converter (ADC) 127, which may be an Analog Devices model AD7705BR. The keypad plate 86 constitutes a data input device which is coupled to the processor 125 and forms part of a user interface, which also includes annunciator apparatus, which may include a buzzer 128, the vibratory motor M and the LCD display 89, all coupled to the processor 125. The battery support assembly 60 carries a battery pack 129, which includes the three "AA" alkaline cells to power the wrench 10. The battery pack 129 is coupled to a voltage regulator 130, which produces a V++ voltage, which may, for example, be 3.3 volts, and which is applied to the EEPROM 126, the processor 125, the keypad 86 and the buzzer 128. The battery pack 129 is also coupled to a voltage regulator 131, which produces a V+ supply voltage which may, for example, be 3.0 volts, and which is applied to the strain gauge bridge 120 and the ADC 127, the regulator 131 being enabled under the control of the processor 125. The battery pack 129 is also coupled to a motor regulator 132, which produces a suitable supply voltage to the vibratory motor M, which may, for example, be 3.0 volts, the motor regulator 132 being enabled under the control of the processor 125.

The strain gauge bridge 120 mounted on the sensor yoke 20 constitutes a sensing device in the nature of a bending-beam measurement transducer, the two deflection sensing gauges 121 and 122 being aligned with the primary bending plane of the beam, and the second pair of gauges 123 and 124 being aligned perpendicular to the primary bending plane. The strain gauge bridge 120 is excited by regulated V+ voltage and delivers a differential output, which may be approximately 6.5 mV at full-scale torque, which output signal is fed through the ADC 127 to the processor 125. The buzzer 128 may be an electromagnetic buzzer, which is driven directly by the processor 125 and may provide audible keypush, preset and overload alerts to the wrench user. The vibratory motor M may be a DC motor rotating an off-axis weight, of the type typically used in personal pagers. The motor M is driven momentarily by the regulated output voltage of the regulator 132 and provides the user with a tactile preset coincidence alert.

In operation, when the user desires to utilize the torque wrench 10, the wrench is turned on by pressing the on/zero key 11. The first time that the wrench is powered up in this manner, the wrench will execute a self test and a zero set operation under the control of suitable program routines, followed by causing the display 89 to display flashing "0000", indicating program mode. The wrench is capable of operation in different modes and these can be manually selected by the user by entering a suitable code number using the increment and decrement keys 113 and 114. Then the units key 112 is pressed to accept or enter the code, whereupon the wrench shuts off. The program mode can be exited by pushing the on/zero key without leaving any changes.

The next time the unit is powered up the display will flash "UCAL" for ten seconds, indicating that the wrench is uncalibrated. The user must then proceed with a calibration procedure to establish full-scale range. After the wrench is calibrated, subsequent power-ups will take 1.5 seconds, during which the buzzer pulses for 0.2 second and the wrench executes self test and zero set routine followed by displaying "0000" for one second, and then displaying any previously-entered set point or predetermined torque level or, if none has been previously set, displaying 20% of full-scale torque as a default set point.

The user may select the units of torque measurement by scrolling through the several different available units, utilizing the units key 112. The first time the units key is depressed the display 89 will display one of the several units selections available. Each push of the units key 112 shifts to the next measurement unit.

The operator can then select a preset torque level or alter a previously-set torque level by using the increment and decrement keys 113 and 114, each push one of these keys incrementing or decrementing the currently-displayed value by one unit. Increment/decrement speed increases as the increment and decrement keys 113 and 114 are held down. The total time to traverse from the center of the measurement scale to either end is less than seven seconds. Once the predetermined torque level is set, the display 89 will continue to display that level until torque is applied by the wrench or until another key is pressed or an internal timer times out.

Once the predetermined torque level is set, the user then utilizes the wrench in a normal manner to apply torque. As soon as torque exceeds the minimum specified display range, the display 89 will begin to display the measured torque value and will track the applied torque, which may be from 5% of full scale up to 125% of full scale. When torque application is released, the display 89 will display the peak torque value applied with a flashing display for 10 seconds. If, during that 10-second interval, the torque is reapplied the display 89 will revert to its tracking mode. Pushing any key will cancel the 10-second peak display period and the display will revert to the function of whatever key was pressed.

When the applied torque reaches the predetermined torque level minus a 2% tolerance, the processor 125 will enable the motor regulator 132 to power the vibratory motor M, which will then run continuously until torque is released. Also, at this time, the buzzer 128 will sound an audible alert for 0.5 seconds. At and above 100% of full scale, the buzzer pulses at a 5-Hz rate. At 125% of full scale the display 89 locks up and displays " - - - ", indicating overload of the wrench. Pressing the on/zero key 111 will reinitiate a self test.

The user may, at any time, display the predetermined torque level by pushing the on/zero key 111, which will momentarily show "0000" for one second and then display the predetermined torque level.

If the sensing apparatus has been damaged due to excessive torque applied, resulting in tare greater than 20% of full scale, then the display 89 will show "Err0." The wrench 10 also will provide a low battery alert. Normally, the display will show a filled-in outline of a battery when it is fully charged, a half-filled outline when the battery is at about half-capacity and, when there is approximately 0.5 hours of battery life remaining, the LCD display 89 will display a flashing battery outline symbol. When this display is active, the accuracy of the wrench will not be affected by a vibratory motor loading. When the batteries are depleted, the display 89 will flash "BAtt", whereupon the wrench will not operate unless the batteries are exchanged.

In calibrating the wrench 10, the user employs the following procedure:

1. Push ON/ZERO KEY to turn wrench on.
2. Momentarily apply full-scale torque three times in the CW direction.
3. Select UNITS (Nm, ft-lb, or in-lb)
4. While pushing the ON/ZERO key, push UP key once momentarily and then push DOWN key until display shows "CAL."
5. With no torque applied, push UNITS key once to set zero into memory.
6. Apply continuous full-scale CW torque using certified torque source.
7. Use UP and DOWN keys to adjust wrench display to match applied torque.
8. Push UNITS key to set full scale into memory.
9. Push ON/ZERO key to accept new calibration parameters. Display momentarily reads "CAL" and then shuts down.
10. Verify calibration at 20%, 60% and 100% of full-scale in both CW and CCW directions.

If the on/zero key 111 is pushed anytime after step 4 and before step 8, the wrench will exit the calibration mode and retain the previous calibration parameters. If the wrench is left idle for two minutes, from any point in the calibration procedure, it will default to the previous calibration parameters and shut down.

If the wrench lies idle for two minutes, i.e., no keys are pushed and no torque is applied, a timer will time out and the wrench will automatically turn off.

The foregoing description applies to a wrench configuration which is designed for automotive service technicians and the like. An alternate configuration might be utilized for industrial uses, such as in automobile assembly plants and the like. That configuration is similar, except that the wrench may also have user-adjustable tolerance values.

Figure 16:
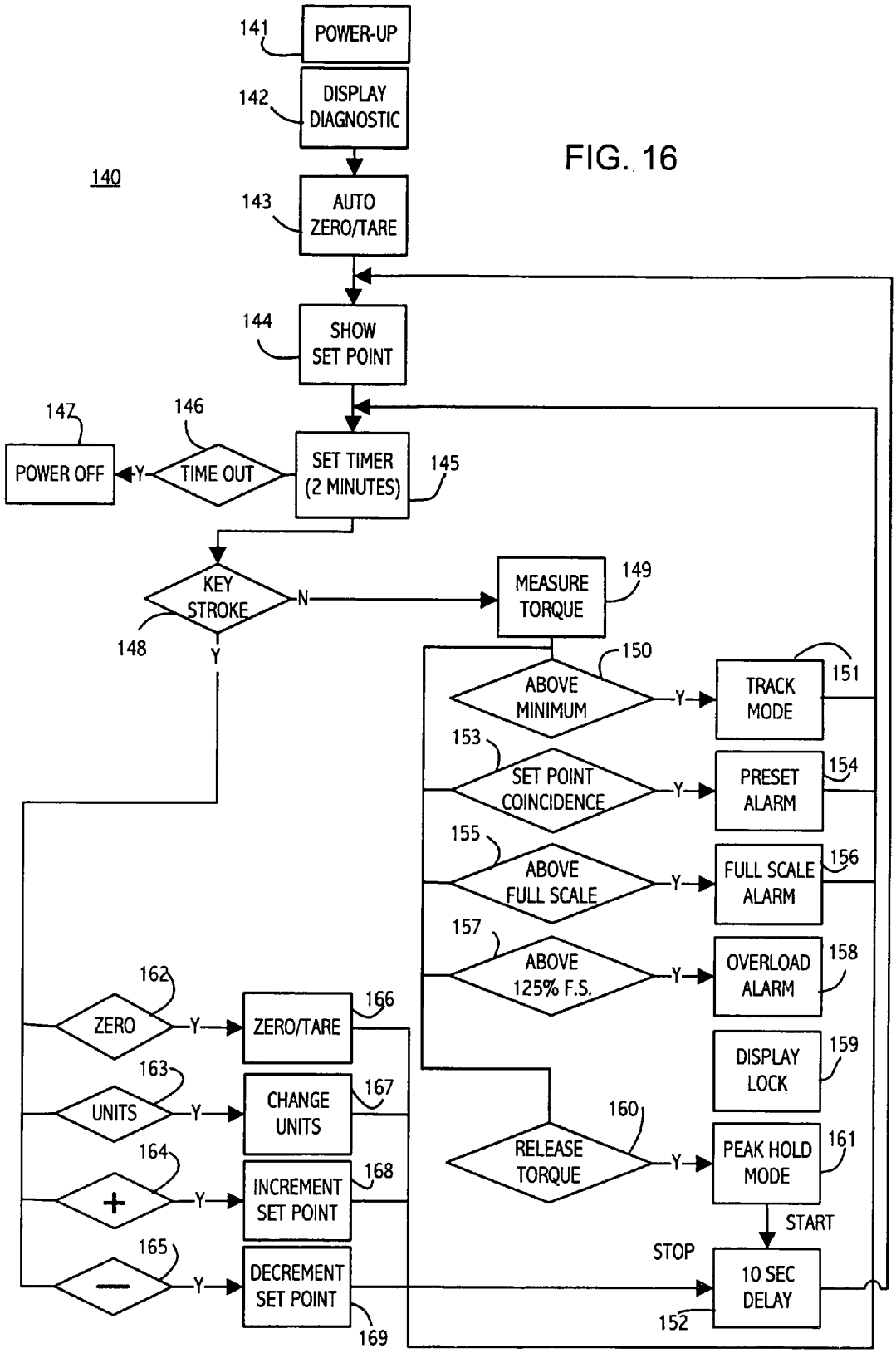
FIG. 16 is a flow chart diagram of the software for operating the circuitry of FIG. 15.

Referring to FIG. 16, there is illustrated a flow chart, illustrating a software program routine 140 for operating the torque wrench 10. When the wrench is powered up, at 141, it executes the power up routine described above, pulsing the buzzer for 0.2 second, executing the self test or display diagnostic function at 142 and the zero set function at 143. Then, at 144, it displays the previous set point or predetermined torque level or, if one has not been previously set, displays 20% of full-scale torque as a default preset. Then, at 145, the program sets a two-minute timer and checks at 146 to see if the timer has timed out. If it has, the wrench is turned off at 147.

After setting the timer at 145, the program also checks at 148 to see if a keystroke has occurred, i.e., that one of the keypad keys has been pushed. If not, the program then, at 149, measures torque applied by the wrench, as sensed by the strain gauge bridge 120, and then checks, at 150, to see if the measured torque is above a minimum value, e.g., 5% of full-scale. If the measured torque is above the minimum, the routine first, at 151, triggers the track mode, causing the display 89 to track and display the measured torque, and then returns to 145 to reset the timer and goes to 152 to stop the ten-second delay for the peak hold display and returns to 144 to display the set point. At this point, the program also checks at 153 to see if set point coincidence has occurred, i.e., whether the measured torque is substantially equal to the predetermined torque level. If it is, the program, at 154, triggers the preset alarm, causing the vibratory motor M and the buzzer 83 to generate their alarm signals in the manner described above and then returns to 145 and 152. The program next checks at 155, to see if the measured torque is above the full scale level. If so, it triggers the full scale alarm at 156, causing the buzzer to give its appropriate alarm, as described above, and then returns to 145 and 152. The program next checks at 157 to see if measured torque is above 125% of full scale. If so, it triggers the overload alarm at 158 and locks the display at 159. The program next checks at 160 to see if torque application has been released. If so, it triggers the peak hold mode at 161, causing the display 89 to display the peak torque value, and starts a ten-second delay period at 152 to display the peak value for ten seconds, after which it returns to 144 to resume displaying the set point. If torque release has not occurred at 160, the program returns to 149 to continue measuring torque.

If, at 148, a keystroke has occurred, the program checks at 162, 163, 164 and 165, respectively, to see if it is the on/zero key, the units key, the increment key or the decrement key which has been actuated to activate the zero/tare function at 166, change the units at 167, increment the set point at 168 or decrement the set point at 169, in each case thereafter resetting the timer at 145 and stopping the ten-second delay period at 152 and returning to 144 to display the set point.

From the foregoing, it can be seen that there has been provided an improved electronic torque wrench which is characterized by intuitive functions which maintain the advantages of prior electronic torque wrenches while, at the same, time effectively simulating prior mechanical "click"-type torque wrenches.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. An electronic torque wrench comprising:

a housing, a workpiece-engaging head carried by the housing, torque measuring apparatus carried by the housing and including a processor operating under stored program control and adapted for coupling to an associated source of electric power, and a user interface carried by the housing and coupled to the torque measuring apparatus, the user interface including a data input device and annunciator apparatus, a processor-readable medium encoded with a program which causes the processor to be responsive at any time, including during application of torque, to the input device for selectively setting or changing a preset torque level, the program causing the processor to compare torque values measured by the torque measuring apparatus with the preset torque level and causing the annunciator apparatus to produce an indication when the measured torque value equals the preset torque level.

2. The electronic torque wrench of claim 1, wherein the data input device includes a keypad.

3. The electronic torque wrench of claim 1, wherein the keypad includes an increment key for incrementing the preset torque level and a decrement key for decrementing the preset torque level.

4. The electronic torque wrench of claim 1, wherein the annunciator apparatus includes a display device, the program causing the processor to be responsive to the input device at any time for causing the display device to display the preset torque level.

5. The electronic torque wrench of claim 1, wherein the annunciator apparatus includes a display device, the program causing the display device to display the peak torque level reached during an application of the electronic torque wrench.

6. The electronic torque wrench of claim 1, wherein the annunciator apparatus includes a display device, the program causing the processor to be responsive to setting or changing a preset torque level of causing the display device to continuously display the changed or preset torque level as long as the display is active until a predetermined change event occurs.

7. The electronic torque wrench of claim 6, wherein the predetermined change event includes operation of the data input device and/or application of torque with the wrench.

8. The electronic torque wrench of claim 1, wherein the annunciator apparatus includes a vibrator for producing a tactile indication when the measured torque value substantially equals the preset torque level.

9. The electronic torque wrench of claim 8, wherein the tactile indication commences when applied torque is within 2% of the preset torque level and continues until torque is released.

10. An electronic torque wrench comprising:

a housing;

a workpiece-engaging head carried by the housing;

torque measuring apparatus carried by the housing and including a processor operating under stored program control and adapted for coupling to an associated source of electric power; and a user interface carried by the housing and coupled to the torque measuring apparatus, the user interface including a key pad and a display device, the key pad including an ON/ZERO key for powering up the wrench and setting a zero level, a UNITS key for toggling among plural different units of torque measurement, an increment key for incrementing a preset torque level, and a decrement key for decrementing a preset torque level; and a processor-readable medium encoded with a program which causes the processor to be responsive to actuation of the key pad keys for performing the functions respectively associated with the keys, the program causing the display device to display the preset torque level in response to actuation of any key.

11. The electronic torque wrench of claim 10, wherein each of the keys has a different shape.

12. The electronic torque wrench of claim 10, wherein the program causes the processor to be responsive to actuation of the units key for the toggling among Newton-meter, foot-pound and inch-pound units of torque measurement.

13. The electronic torque wrench of claim 10, wherein the increment key and the decrement key are arrow keys.

14. The electronic torque wrench of claim 10, wherein the program causes the processor to automatically turn off the wrench if, during a predetermined time interval, no torque has been applied and no key has been actuated.

15. An electronic torque wrench comprising:

a housing, a workpiece-engaging head carried by the housing, torque measuring means carried by the housing and including processing means operating under stored program control and adapted for coupling to an associated source of electric power, and user interface means carried by the housing and coupled to the torque measuring means, the user interface means including data input means and annunciator means, the processing means including means responsive at any time, including during application of torque, to the input means for selectively setting or changing a preset torque level.

16. The electronic torque wrench of claim 15, wherein the data input means includes arrow keys for respectively incrementing and decrementing the preset torque level.

17. The electronic torque wrench of claim 15, wherein the data input means includes a keypad having an on/zero key for powering up the wrench and setting a zero level a units key for toggling among plural different units of torque measurement, an increment key for incrementing the present torque, and a decrement key for decrementing the preset torque level, the processing means including means responsive to actuation of the keypad keys for performing the functions respectively associated with the keys.

* * * * *